US005730107A

United States Patent [19]

Blumenstock

[11] Patent Number: 5,730,107

[45] Date of Patent: Mar. 24, 1998

[54] PUMP DEVICE FOR A FUEL VAPOR TRAPPING SYSTEM, AND FUEL VAPOR TRAPPING SYSTEM

[75] Inventor: Andreas Blumenstock, Ludwigsburg, Germany

[73] Assignee: Robert Bosch, GmbH, Stuttgart, Germany

[21] Appl. No.: 793,580

[22] PCT Filed: May 3, 1996

[86] PCT No.: PCT/DE96/00768

§ 371 Date: Feb. 28, 1997

§ 102(e) Date: Feb. 28, 1997

[87] PCT Pub. No.: WO97/02420

PCT Pub. Date: Jan. 23, 1997

[30] Foreign Application Priority Data

Jun. 30, 1995 [DE] Germany ..... 195 23 936.9

[51] Int. Cl.[6] ..... F02M 33/02

[52] U.S. Cl. ..... 123/520

[58] Field of Search ..... 123/516, 518, 123/519, 520, 198 D

[56] References Cited

U.S. PATENT DOCUMENTS 5,411,004 5/1995 Busato ..... 123/520

5,474,050 12/1995 Cook et al. ..... 123/520

5,499,614 3/1996 Busato et al. ..... 123/520

*Primary Examiner*—Thomas N. Moulis

*Attorney, Agent, or Firm*—Edwin E. Greigg; Ronald E. Greigg

[57] ABSTRACT

A common feature of known pump devices, which for diagnostic purposes build up an overpressure in a fuel vapor trapping system, is that a connection of an adsorption filter with the ambient air is closed for the duration of the diagnosis. In the event of a malfunction of the shutoff valve, for instance from seizing, a buildup of negative pressure that is dangerous to the fuel tank can occur, which can be avoided by guard valves provided on the fuel tank according to the following pump device, whose valves needed for generating the overpressure are embodied such that in an open position of a regeneration valve and in a closing position of a shutoff valve, by means of an adequate flow cross section $A_{Schutz}$ of the valves such a slight flow resistance is effected that an attainment of a negative pressure harmful to the fuel tank is precluded. The pump device according to the invention is intended for a fuel vapor trapping system of an internal combustion engine.

10 Claims, 1 Drawing Sheet

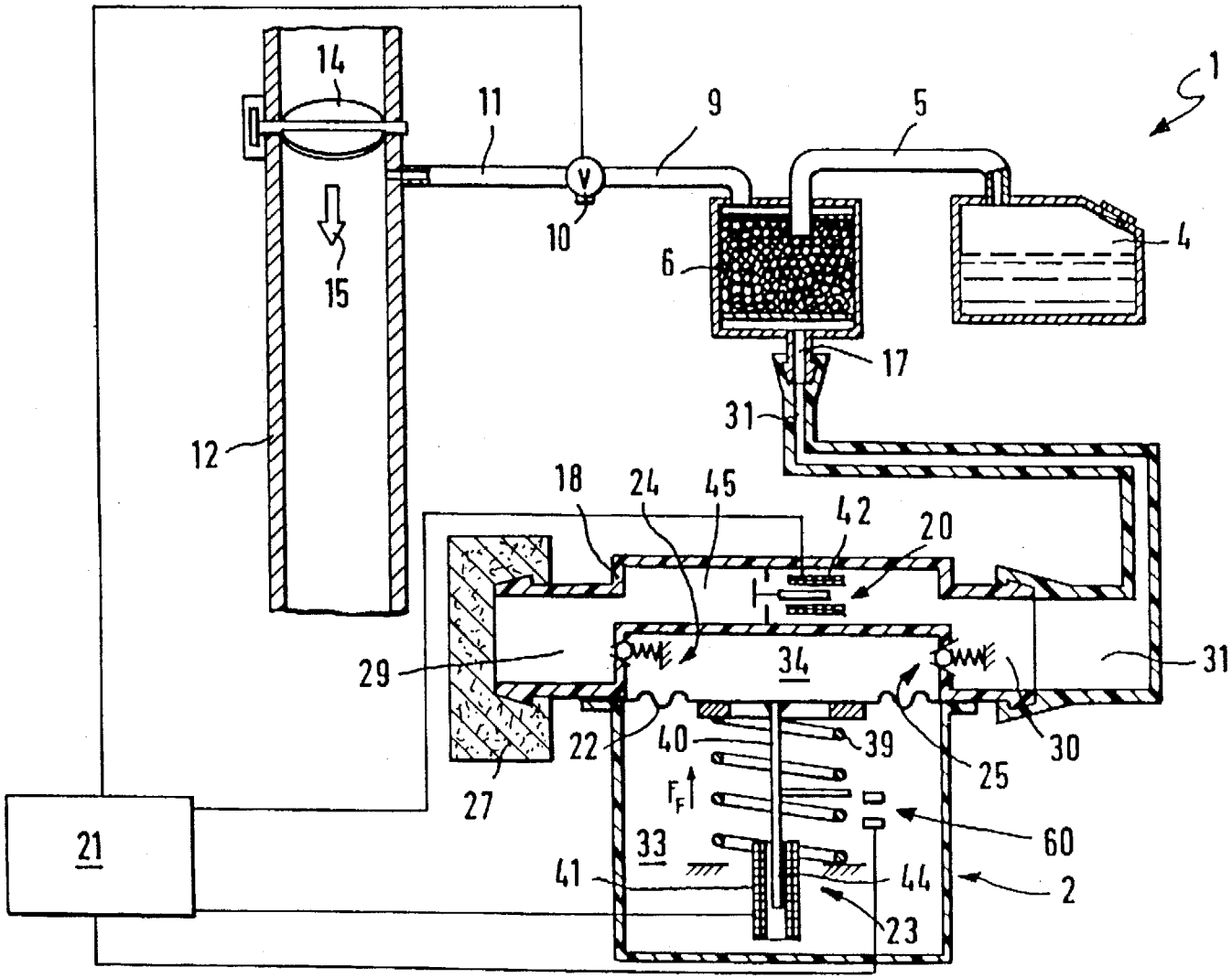
1
4
5
6
9
10
11
12
14
15
17
18
20
21
22
23
24
25
27
29
30
31
33
34
39
40
41
42
44
45
60
2
$F_F$

PUMP DEVICE FOR A FUEL VAPOR TRAPPING SYSTEM, AND FUEL VAPOR TRAPPING SYSTEM

PRIOR ART

The invention is based on a pump device for a fuel vapor trapping system, and on a fuel vapor trapping system, respectively. A pump device is already known (International Patent Disclosure WO 94/15090) that is intended for checking the tightness of a fuel vapor trapping system, so that by means of the pump device a defined volume of air can be delivered, via an aeration connection of an adsorption filter, to a fuel tank of the internal combustion engine to bring about a pressure increase. In order to ascertain whether the fuel vapor trapping system is pressure-tight, one waits for plenty of time after the pressure buildup has been concluded in order to determine whether there is a leak upon a pressure reduction in the fuel vapor trapping system; the time elapsed for the pressure reduction is a measure of the size of the leakage opening. The fuel vapor trapping system also includes a regeneration valve, which is provided between the adsorption filter and an intake tube of the engine, so that the fuel vapor temporarily stored in the adsorption filter can be introduced into the intake tube by means of the regeneration valve.

The pump device disclosed in the prior art has a pump diaphragm, which is acted upon in alternation with negative pressure and ambient pressure for its drive. The negative pressure is drawn, with the engine running, from the engine intake tube via a negative pressure hose, and it is delivered via a switching valve, which is embodied for instance as an electromagnetic valve, to a pump chamber, defined by the switching valve and the pump diaphragm, of the pump device. By switching of the switching valve, negative pressure and ambient pressure are established in alternation in the pump chamber. When the pump chamber is acted upon with negative pressure, the pump diaphragm moves upward counter to the pressure force of a pump spring; air from a supply line flows into a feed chamber opposite the pump chamber; air from a supply line flows into a feed chamber, facing the pump chamber, that is closed off by the pump diaphragm and two shutoff valves, that is, one overpressure valve and one negative pressure valve. In the ensuing imposition of ambient pressure on the pump chamber, the pump diaphragm, reinforced by the pressure force of the pump spring, moves in the opposite direction, compressing the air enclosed in the feed chamber. When a certain overpressure is reached in the feed chamber, the overpressure valve opens, so that the ambient air compressed in the feed chamber can flow via the feed line into an aeration line of the adsorption filter, in order to bring about a pressure increase in the fuel tank. Only during operation of the pump device does the shutoff valve, connected between the supply line and the feed line parallel to the shutoff valves, assume a closing position, in which a connection of the supply line with the feed line is broken. If operation of the pump device or a check of the fuel vapor trapping system for tightness is not contemplated, then the shutoff valve remains in an open position, so that in the open position ambient air can be introduced, for instance via an ambient-air filter provided in the supply line, into the adsorption filter for regeneration thereof.

A pump device that furnishes an overpressure for a tightness checking is also known from International Patent Application WO 94/17298; in it, a blower motor is provided as the pump device. The blower motor is connected to an aeration connection of the adsorption filter via a line and a check valve. At the aeration connection, an electromagnetically actuatable shutoff valve is also provided, which is connected to the line parallel to the blower motor. When the blower motor is in operation, the shutoff valve assumes a closing position, so that an overpressure in the fuel tank can be built up by means of the blower motor.

A common feature of all the pump devices of this kind, which by the process described above furnish an overpressure for purposes of checking tightness, is that a connection of the adsorption filter with the ambient air remains closed for the duration of the diagnosis. However, that increases the danger that if the shutoff valve malfunctions, for instance if it sticks permanently in a closed position, the fuel tank will be gradually evacuated by the negative pressure of the intake tube when the regeneration valve opens. The negative pressure can attain values in the fuel tank that exceed a maximum allowable negative pressure for the fuel tank, and the result can be destruction of the fuel tank. To prevent this, guard valves are typically mounted on the fuel tank; they comprise one overpressure valve and one negative pressure valve, so that at a certain overpressure or under pressure in the fuel vapor trapping system, they open in order to establish pressure equilibrium with the ambient air. However, as a rule, such guard valves are not actuated at all; they are actuated only in the case of a malfunction, such as a sticking shutoff valve, but the intrinsic risk is then that because they are unused for long periods, they might not function in an individual case, for instance because they are soiled or sticky, so that in the worst case, damage to the fuel tank and the escape of fuel to the environment can occur. Moreover, it is not possible for such defective guard valves to be noticed before they are used to protect the fuel tank. There is accordingly a need to achieve a more-effective protection for the fuel tank.

ADVANTAGES OF THE INVENTION

The pump device according to the invention and the fuel vapor trapping system according to the invention, respectively, have the advantage over the prior art of enabling simple protection of the fuel tank against overly high negative pressures that damage the fuel tank without requiring major structural changes in existing pump devices. Advantageously, a guard valve arrangement of the kind conventional until now in the prior art, with a negative pressure valve provided for example on the fuel tank, can be omitted, with attendant cost savings. It is especially advantageous that in the context of tightness diagnosis of the fuel vapor trapping system by means of the pump device, the guard valves can also be checked for their functional capacity, so that a malfunction of the guard valves can be ascertained immediately, thereby with very great security precluding damage to the fuel tank from defective guard valves.

By means of the provisions recited herein, advantageous further features of and improvements to the pump device disclosed and the fuel vapor trapping system disclosed are possible.

BRIEF DESCRIPTION OF THE DRAWING

One exemplary embodiment of the invention is shown in simplified form in the drawing and described in further detail in the ensuing description.

DESCRIPTION OF THE EXEMPLARY EMBODIMENT

The drawing shows a fuel vapor trapping system, identified by reference numeral 1, for an internal combustion engine not otherwise shown; the system is equipped with a pump device 2 according to the invention, which is shown with a schematically simplified mode of operation and which for diagnostic purposes builds up an overpressure in the fuel vapor trapping system 1. The fuel vapor trapping system 1 further includes a fuel tank 4 for supplying fuel to the engine, and an adsorption filter 6 connected to the fuel tank 4 via a tank line 5. The adsorption filter 6 is filled with an adsorption medium, especially activated charcoal, and is connected via a connecting line 9 to a regeneration valve 10, which is connected via a valve line 11 to an intake tube 12 of the engine. The valve line 11 for instance discharges downstream of a throttle valve 14, mounted rotatably in the intake tube 12 of the engine, in which an air or fuel-air mixture flows in the direction of an arrow 15. In operation of the engine, negative pressure prevails in the intake tube 12 downstream of the throttle valve 14, and with the aid of this negative pressure, the fuel vapors are aspirated from the fuel tank with the regeneration valve 10 opened. The fuel vapors thus pass from the fuel tank 4 via the tank line 5 into the adsorption filter 6 and from there into the connecting line 9; ambient air is aspirated by the negative pressure in the intake tube 12 via an aeration connection 17 provided at the adsorption filter 6, so that the fuel temporarily stored in the adsorption filter 6 is entrained with the ambient air. The fuel vapors temporarily stored in the adsorption filter 6 mix with the ambient air flowing in via the aeration connection 17. Via the regeneration valve 10, which for example is embodied as electromagnetically actuatable and which is triggered in clocked fashion by an electronic control unit 21, the fuel vapors pass via the valve line 11 into the intake tube 12, and are then combusted in at least one engine combustion chamber.

To check the fuel vapor trapping system 1 for. tightness, the regeneration valve 10 is closed. Next, a defined volume of air is supplied to the fuel tank 4 by means of the pump device 2 via the adsorption filter 6, in order to cause a pressure increase. Once the pressure buildup is concluded, there is a wait, long enough for the pressure to decrease again, possibly from a leak in the fuel vapor trapping system 1; the time elapsed for the pressure decrease is a measure of the size of the leakage opening that has occurred in the fuel vapor trapping system 1. This tightness checking of the fuel vapor trapping system 1, also known as the overpressure method, makes it possible to find leakage openings of an order of magnitude of less than 1 mm in diameter. If the overpressure in the fuel vapor trapping system 1 is not attained even after a certain number of pump strokes of a pump diaphragm 22 of the pump device 2, then it can be concluded that there is a large leak or a missing tank cap on the fuel tank 4. In that case, it is possible, via the electronic control unit 21 connected to the pump device 2, to trigger an indicator device, accommodated for instance in the passenger compartment, so that the driver can be informed of the incident malfunction of the fuel vapor trapping system 1.

The overpressure needed for monitoring purposes is furnished by the pump device 2 of the invention, which in the pumping operation aspirates ambient air, for instance via an ambient air filter 27 disposed in or on a housing 18 of the pump device 2, into a supply line 29 so as to pump it subsequently at an elevated pressure into a feed line 30. The feed line 30 is connected, for instance via a separate line 31, to the aeration connection 17 of the adsorption filter 6. The pump device 2 is composed of a plurality of individual components, functionally separate from one another, which are accommodated in the housing 18 and essentially include a shutoff valve 20 and a pumping portion 23. The pumping portion 23 is provided in order to compress the ambient air, and it is composed of the pump diaphragm 22, a pump tappet 40, a device 60 that detects the position of the pump tappet 40, a pump spring 39, and a valve assembly formed by a negative pressure valve 24 and an overpressure valve 25. The device 60 may for example be embodied in the form of a so-called Reed switch, known to one skilled in the art, or in the form of an electrical contact provided on the pump tappet 40, or the like. The pump diaphragm 22 divides the pumping portion 23 into a pump chamber 33, shown in the drawing below the pump diaphragm 22, and a feed chamber 34, shown above the pump diaphragm 22. The feed chamber 34 is closed off pressure tight from the ambient air, when the pump is not in operation, by the pump diaphragm 22, the negative pressure valve 24, and the overpressure valve 25. The negative pressure valve 24 and the overpressure valve 25 are embodied as one-way valves, so that the negative pressure valve 24 opens counter to a restoring force only in the direction toward the feed chamber 34, and the overpressure valve 25 opens counter to a restoring force only in the direction of the feed line 30. The pumping portion 23 by way of example further includes an electromagnetic drive, to which end, to drive the pump diaphragm 22, a magnetic armature 44 is provided, for instance on the pump tappet 40; the armature can be moved back and forth, preferably at a relatively high pumping frequency, by magnetic forces of an electromagnet provided With an exciter coil 41. The shutoff valve 20 is embodied as electromagnetically actuatable, for instance, and to that end likewise has a magnetic armature, which is movable by magnetic forces of an electromagnet provided with an exciter coil 42. The triggering of the exciter coils 41, 42, the device 60 for detecting the position of the pump tappet 40, and the regeneration valve 10 is done, for instance via electric lines by means of the electronic control unit 21.

During operation of the pump device 2, the shutoff valve 20 connected between the supply line 29 and the feed line 30 parallel to the valves 24, 25 assumes a closing position, in order to interrupt connection between the supply line 29 and the feed line 30. In the compression operation, the pump diaphragm 22 shown in the drawing moves in the direction toward the feed chamber 34, and the ambient air enclosed in the feed chamber 34 is compressed. The valves 24, 25 connected parallel to the shutoff valve 20 between the supply line 29 and the feed line 30 initially assume a closing position in this process. Upon attainment of a certain overpressure, dependent on the design of the overpressure valve 25, in the feed chamber 34, the overpressure valve 25 opens in the direction of the feed line 30, so that compressed air can flow from the feed chamber 34 into the adsorption filter 6, via the feed line 30 and the line 31. In the ensuing opposite motion of the pump diaphragm 22 in the direction toward the pump chamber 33, the overpressure valve 25 closes, and the negative pressure valve 24 opens; ambient air is aspirated from the supply line 29 into the feed chamber 34. If operation of the pump device 2 for tightness checking of the fuel vapor trapping system 1 happens not to be desired, then the shutoff valve 20 remains in the open position shown in the drawing. In the opening position of the shutoff valve 20, with the regeneration valve 10 open, and the ambient air for regenerating the adsorption filter 6 can flow via the ambient air filter 27, provided at the supply line 29, and through a bypass conduit 45 into the feed line 30, and from there via the line 31 and the aeration connection 17 into the adsorption filter 6.

According to the invention, the two valves 24, 25, both of which open only in a direction in which an air flow from the supply line 29 to the feed line 30 via the feed chamber 34 takes place, are embodied such that upon a closure of the shutoff valve 20 from a malfunction, no buildup of negative pressure which would be harmful to the fuel tank 4 can occur. Accordingly, in the event of a malfunction of the shutoff valve 20, for instance by seizing permanently in a closing position, it must be assured that the negative pressure prevailing in the fuel tank 4 is always less in amount, compared with atmospheric pressure, than the amount of a maximum allowable fuel tank negative pressure $p_{TM}$ compared with the atmospheric pressure. The maximum allowable fuel tank negative pressure $p_{TM}$ is equivalent to negative pressure at which a threat to the fuel tank 4 is precluded with certainty. For commercially available fuel tanks 4, the fuel tank negative pressure $p_{TM}$ is approximately 10–30 hPa (hectopascals). In order to effect a negative pressure in the fuel tank 4 that is quantitatively below the maximum allowable fuel tank negative pressure $p_{TM}$, or in other words has a lesser pressure difference from the atmospheric pressure, both valves 24, 25 have a flow cross section $A_{Schutz}$, dimensioned such that in the event of a closed shutoff valve 20 and an open regeneration valve 10, the sum of the amounts of the pressure losses at the valves 24, 25 and at the adsorption filter 6 is always smaller than the amount of the maximum allowable fuel tank negative pressure $p_{TM}$ of the fuel tank 4, so that damage to the fuel tank 4 is precluded with certainty.

The requisite flow cross section $A_{Schutz}$ of the valves 24, 25 can be ascertained by means of an idealized observation of the valves 24, 25 as throttling devices, which are embodied in the form of a baffle. Such baffles are accommodated in a pipeline and cause a defined flow resistance in the flow that leads to a pressure difference at the baffle, or a pressure loss in the flow. The calculation of this kind of baffle-caused pressure loss is familiar to one skilled in the art. In the design of the flow cross section $A_{Schutz}$ of the valves 24, 25, the least favorable case is also assumed, which is that the regeneration valve 10, in an open position, outputs its maximum possible introduced quantity into the intake tube 12 at the mass flow rate $m_{TEV}$. For the sake of continuity, the mass flow rate $m_{TEV}$ of the regeneration valve 10 is equivalent to the mass flow rate $m_{Schutz}$ flowing through the valves 24, 25. The result is a continuity equation in the following form:

$$m_{TEV}=m_{Schutz} \tag{1}$$

On the assumption of an ideal gas and using the Bernoulli equation and the continuity equation (1) and the idealized observation of the valves 24, 25 and the regeneration valve 10 as baffles, a relationship of the flow cross section $A_{Schutz}$ of the valve 24 or the valve 25 can also be given, as a function of the flow cross section $A_{TEV}$ of the regeneration valve 10:

$$A_{Schutz}=\frac{\alpha_{TEV}*A_{TEV}*p_{TM}*\sqrt{\left(\frac{p_{SF}}{p_{TM}}\right)^{2/\kappa}-\left(\frac{p_{SF}}{p_{TM}}\right)^{(\kappa+1)/\kappa}}}{\alpha_{Schutz}*p_a*\sqrt{\left(\frac{p_{TM}}{n*p_a}\right)^{2/\kappa}-\left(\frac{p_{TM}}{n*p_a}\right)^{(\kappa+1)/\kappa}}}, \tag{2}$$

in which $p_{TM}$ is the maximum allowable fuel tank negative pressure, $p_a$ is the ambient pressure, $p_{SF}$ is the negative pressure in the intake tube 12, n is the number of series-connected valves (in the exemplary embodiment, n=2), k is the polytropic exponent of air (k=1.4), $\alpha_{TEV}$ is the flow coefficient of the regeneration valve 10, and $\alpha_{Schutz}$ is the flow coefficient of the valves 24, 25. The flow coefficients $\alpha_{TEV}$ and $\alpha_{Schutz}$ represent correction factors, which describe the opening ratio of a baffle as a function of the Reynolds number Re and are known to one skilled in the art, for example from relevant tables in the literature.

The individual flow cross sections $A_{Schutz}$ of the valves 24, 25, calculated by formula (2) as a function of the known flow cross section $A_{TEV}$ of the regeneration valve 10 have such a slight flow loss between the supply line 29 and the feed line 30 that the pressure less along the valves 24, 25 and the adsorption filter 6, which loss determines the negative pressure in the fuel tank 4, always remains below the maximum allowable fuel tank negative pressure $p_{TM}$. It is therefore possible to dispense with a negative pressure valve, which otherwise is absolutely compulsory for safety reasons, on the fuel tank 4.

In order moreover to assure that the fuel tank 4 cannot burst even at an overpressure that might occur, an overpressure valve conventionally provided in the tank cap, for instance, can continue to be used. The invention is not limited to the pump device 2 described in the exemplary embodiment and for instance driven by an electromagnetic drive, having a shutoff valve 20 embodied as electromagnetically actuatable. It is understood that it is also possible to use the pump device, described in the prior art, driven by negative pressure in the intake tube or a pump device in the form of a blower motor or the like, or to modify its guard valves accordingly in accordance with the invention.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A pump device for a fuel vapor trapping system of an internal combustion system, which comprises an adsorption filter that is connected to a fuel tank and to a regeneration valve, said adsorption filter includes an aeration connection (17) which is connected to the pump device and can be shut off from ambient air by a shutoff valve (20), the pump device (2) has at least one valve (24; 25), which in an open position of the regeneration valve (10) and in a closed position of the shutoff valve (20) has a flow cross section $A_{Schutz}$ dimensioned in such a way that an open position of the at least one valve (24; 25), by the inflow of air into the fuel vapor trapping system (1), an attainment of a negative pressure $p_{TM}$ harmful to the fuel tank (4) is precluded.

2. The pump device of claim 1, in which the pump device (2) has a pump diaphragm (22), which defines a feed chamber (34) with first and second valves (24, 25) that have a flow cross section $A_{Schutz}$ dimensioned in such a way that in an open position of the first and second valves (24, 25), by the inflow of ambient air via a supply line (29) connected to the first valve (24) into the feed chamber (34) and from the feed chamber (34) via a feed line (30) connected to the second valve (25) into the adsorption filter (6), an attainment of the negative pressure $p_{TM}$ harmful to the fuel tank (4) is precluded.

3. The pump device of claim 1, in which a design of the flow cross section $A_{Schutz}$ of the at least one valve (24; 25) is effected such that a sum of individual amounts of the pressure losses at the at least one valve (24; 25) and at the adsorption filter (6) is below an amount of maximum allowable fuel tank negative pressure $p_{TM}$.

4. The pump device of claim 2, in which a design of the flow cross section $A_{Schutz}$ of the first and second valves (24, 25) are effected such that a sum of individual amounts of the pressure losses at the first and second valve (24; 25) and at the adsorption filter (6) is below an amount of a maximum allowable fuel tank negative pressure $p_{TM}$.

5. The pump device of claim 1, in which a design of the flow cross section $A_{Schutz}$ of the at least one valve (24; 25) is carried out as a function of a flow cross section $A_{TEV}$ of the regeneration valve (10) using the following formula:

$$A_{Schutz} = \frac{\alpha_{TEV} * A_{TEV} * p_{TM} * \sqrt{\left(\frac{p_{SF}}{p_{TM}}\right)^{2/\kappa} - \left(\frac{p_{SF}}{p_{TM}}\right)^{(\kappa+1)/\kappa}}}{\alpha_{Schutz} * p_a * \sqrt{\left(\frac{p_{TM}}{n * p_a}\right)^{2/\kappa} - \left(\frac{p_{TM}}{n * p_a}\right)^{(\kappa+1)/\kappa}}}$$

in which $p_{TM}$ is the maximum allowable fuel tank negative pressure, $p_a$ is the ambient air pressure, $p_{SF}$ is the negative pressure in the intake tube 12, n is the number of series-connected valves, k is the polytropic exponent of air (k=1.4), $\alpha_{TEV}$ is the flow coefficient of the regeneration valve 10, and $\alpha_{Schutz}$ is the flow coefficient of the at least one valve.

6. The pump device of claim 1, in which a design of the flow cross section $A_{Schutz}$ of the at least one valve (24; 25) is carried out as a function of a flow cross section $A_{TEV}$ of the regeneration valve (10) using the following formula:

$$A_{Schutz} = \frac{\alpha_{TEV} * A_{TEV} * p_{TM} * \sqrt{\left(\frac{p_{SF}}{p_{TM}}\right)^{2/\kappa} - \left(\frac{p_{SF}}{p_{TM}}\right)^{(\kappa+1)/\kappa}}}{\alpha_{Schutz} * p_a * \sqrt{\left(\frac{p_{TM}}{n * p_a}\right)^{2/\kappa} - \left(\frac{p_{TM}}{n * p_a}\right)^{(\kappa+1)/\kappa}}}$$

in which $p_{TM}$ is the maximum allowable fuel tank negative pressure, $p_a$ is the ambient pressure, $p_{SF}$ is the negative pressure in the intake tube 12, n is the number of series-connected valves, k is the polytropic exponent of air (k=1.4), $\alpha_{TEV}$ is the flow coefficient of the regeneration valve 10, and $\alpha_{Schutz}$ is the flow coefficient of the valves.

7. A fuel vapor trapping system for an internal combustion system, which comprises an adsorption filter that can be connected to a fuel tank and to a regeneration valve, said adsorption filter includes an aeration connection which is connected to the pump device and can be shut off from ambient air by a shutoff valve (20), the pump device (2) has at least one valve (24; 25), which in an open position of the regeneration valve (10) and in a closed position of the shutoff valve (20) has a flow cross section $A_{Schutz}$ dimensioned in such a way that an open position of the at least one valve (24; 25), by an inflow of air into the fuel vapor trapping system (1), an attainment of a negative pressure $p_{TM}$ harmful to the fuel tank (4) is precluded.

8. The fuel vapor trapping system of claim 7, in which the pump device (2) has a pump diaphragm (22), which defines a feed chamber (34) including first and second valves (24, 25) that have a flow cross section $A_{schutz}$ dimensioned in such a way that in an open position of the first and second valves (24, 25), by an inflow of air via a supply line (29) connected to the first valve (24) into the feed chamber (34) and from the feed chamber via a feed line (30) connected to the second valve (25) into the adsorption filter (6), an attainment of the negative pressure $p_{TM}$ harmful to the fuel tank (4) is precluded.

9. The fuel vapor trapping system of claim 7, in which the design of the flow cross section $A_{schutz}$ of the at least one valve (24; 25) is effected such that a sum of individual amounts of the pressure losses at the at least one valve (24; 25) and at the adsorption filter (6) is always below an amount of a maximum allowable fuel tank negative pressure $p_{TM}$.

10. The fuel vapor trapping system of claim 7, in which the design of the flow cross section $A_{schutz}$ of the first and second valves (24, 25) are such that a sum of individual amounts of the pressure losses at said first and second valves (24; 25) and at the adsorption filter (6) is always below an amount of a maximum allowable fuel tank negative pressure $p_{TM}$.

* * * * *